US005209046A

United States Patent [19]

Tapscott et al.

[11] Patent Number: 5,209,046

[45] Date of Patent: May 11, 1993

[54] METHOD AND APPARATUS FOR INSERTING ARTICLES INTO PACKAGES

[75] Inventors: Donald A. Tapscott, Cobourg; Josef F. Vrana, Roseneath, both of Canada

[73] Assignee: Kraft General Foods Canada, Inc., Don Mills, Canada

[21] Appl. No.: 835,647

[22] Filed: Feb. 13, 1992

Related U.S. Application Data

[63] Continuation of Ser. No. 702,979, May 20, 1991, abandoned.

[51] Int. Cl.[5] ..... B65B 39/00; B65B 57/02; B65B 61/20

[52] U.S. Cl. ..... 53/473; 53/474; 53/493; 53/505; 53/238; 53/250; 53/255; 53/258

[58] Field of Search ..... 221/84, 85, 250; 53/238, 249, 248, 250, 255, 260, 261, 262, 473, 474, 493, 505, 258

[56] References Cited

U.S. PATENT DOCUMENTS

| | | | |
|---|---|---|---|
| 2,510,343 | 6/1950 | Krause et al. | 53/261 |
| 3,710,543 | 1/1973 | Toss | 53/248 X |
| 3,955,335 | 5/1976 | Yates | 53/505 X |
| 4,027,459 | 6/1977 | Nieskens et al. | 53/505 X |
| 4,054,015 | 10/1977 | Rowell | 53/473 X |
| 4,192,121 | 3/1980 | Caudle | 53/258 X |
| 4,709,535 | 12/1987 | Mahaffy et al. | 53/473 |
| 4,864,801 | 9/1989 | Fallas | 53/473 X |
| 4,899,518 | 2/1990 | Beeman et al. | 53/473 X |
| 5,079,901 | 1/1992 | Kotsiopoulos | 53/474 X |

*Primary Examiner*—John Sipos
*Assistant Examiner*—Linda B. Johnson
*Attorney, Agent, or Firm*—Linn I. Grim

[57] ABSTRACT

The present inventin is an apparatus and method for inserting articles into packages. The apparatus includes a dispensing assembly and a feeding assembly; and the dispensing assembly, in turn, includes a dispenser body, a gate and an actuator. The dispensor body defines a loading chamber for holding the articles, an inlet for conducting the articles into the loading chamber, and an outlet for dispensing the articles from the loading chamber. The gate is connected to the dispenser body for movement between a closed position, wherein the gate extends across the outlet of the dispenser body to hold the articles in the loading chamber, and an open position to allow the articles to pass through the outlet of the dispenser body. The actuator of the dispensing assembly is provided to move the gate from its closed position to its open position to dispense articles into the packages from the dispenser body. The feeding assembly extends adjacent the inlet of the dispenser body for receiving the articles from a source thereof and transporting the articles into the inlet of the dispenser body. Preferably, the apparatus further comprises a control assembly to coordinate the operation of the dispensing assembly and the feeding assembly so that each time one of the packages passes beneath the dispenser, one, and preferably only one, of the articles is inserted into that package.

11 Claims, 5 Drawing Sheets

METHOD AND APPARATUS FOR INSERTING ARTICLES INTO PACKAGES

This is a continuation, of application Ser. No. 07/702,979, filed May 20, 1991, now abandoned.

BACKGROUND OF THE INVENTION

This invention generally relates to method and apparatus for inserting articles into packages, and more specifically, to such methods and apparatus that are well suited for inserting odd or unusually shaped articles into packages.

Many consumer products are often provided with an object or article in addition to the primary product. For example, small toys, souvenir items, or other articles, referred to as premiums, are often placed in cereal packages. While the package is purchased by the consumer primarily for the cereal, the premium in the package provides an additional incentive to buy the product and to help distinguish the product from other types or brands of cereal.

Often, these premiums do not have a simple geometric shape, and for instance, they may be in the shape of an animal or vehicle. Such odd shaped premiums are not well suited for use with conventional apparatus for dispensing or inserting articles into the back of packages; and consequently, heretofore, such odd-shaped premiums were typically inserted into packages by hand.

SUMMARY OF THE INVENTION

The present invention is an apparatus and method for inserting articles into packages. The apparatus includes a dispensing assembly and a feeding assembly; and the dispensing assembly, in turn, includes a dispenser body, a gate, and actuating means. The dispenser body defines a loading chamber for holding the articles, an inlet for conducting the articles into the loading chamber, and an outlet for dispensing the articles from the loading chamber. The gate is connected to the dispenser body for movement between a closed position, wherein the gate extends across the outlet of the dispenser body to hold the articles in the loading chamber, and an open position to allow the articles to pass through the cutlet of the dispenser body. The actuating means of the dispensing assembly is provided to move the gate from its closed position to its open position to dispense articles into the packages from the dispenser body. The feeding assembly extends adjacent the inlet of the dispenser body for receiving the articles from a source thereof and transporting the articles into the inlet of the dispenser body.

Preferably, the apparatus further comprises a control assembly to coordinate the operation of the dispensing assembly and the feeding assembly so that each time one of the packages passes beneath the dispenser, one, and preferably only one, of the articles is inserted into that package. Also, preferably the gate of the dispensing assembly includes first and second members that are pivotally connected to the dispenser body for movement toward and away from the outlet thereof, and biasing means that bias those first and second gate members toward the outlet of the dispenser body. With this preferred embodiment, the actuating means includes a pneumatic cylinder that is selectively actuated to slide a plunger downward through the dispenser body. As the plunger slides downward, it engages an article inside the loading chamber of the dispenser body, forces the gate members away from the outlet of the dispenser body, and pushes the article into a package beneath the dispenser body.

DETAILED DESCRIPTION OF THE PREFERRED EMBODIMENTS

Figure 2:
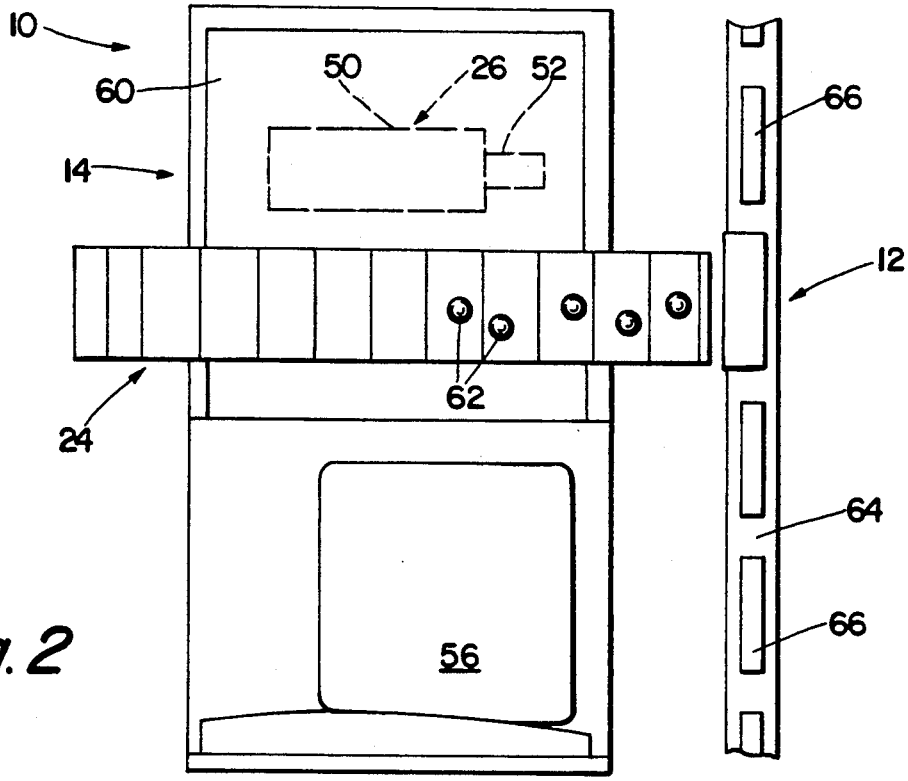
FIG. 2 is a top plan view of the apparatus of FIG. 1.
Figure 1:
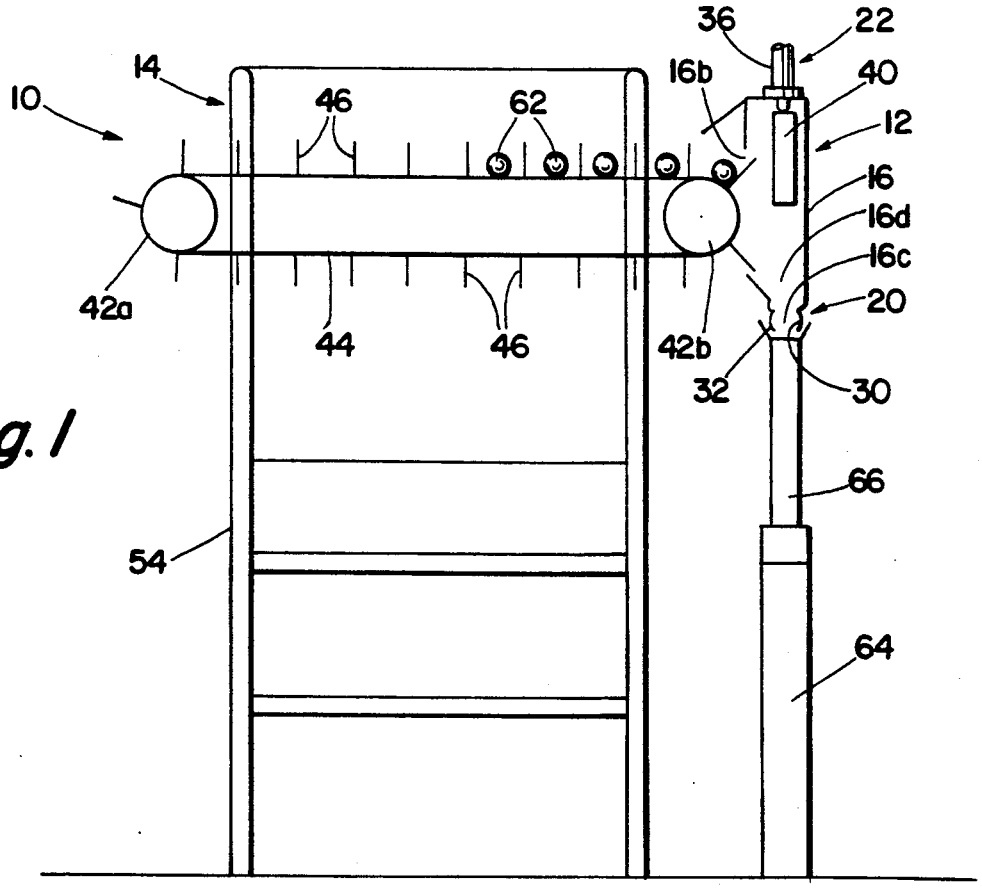
FIG. 1 is a front-view of an apparatus embodying the present invention.
Figure 3:
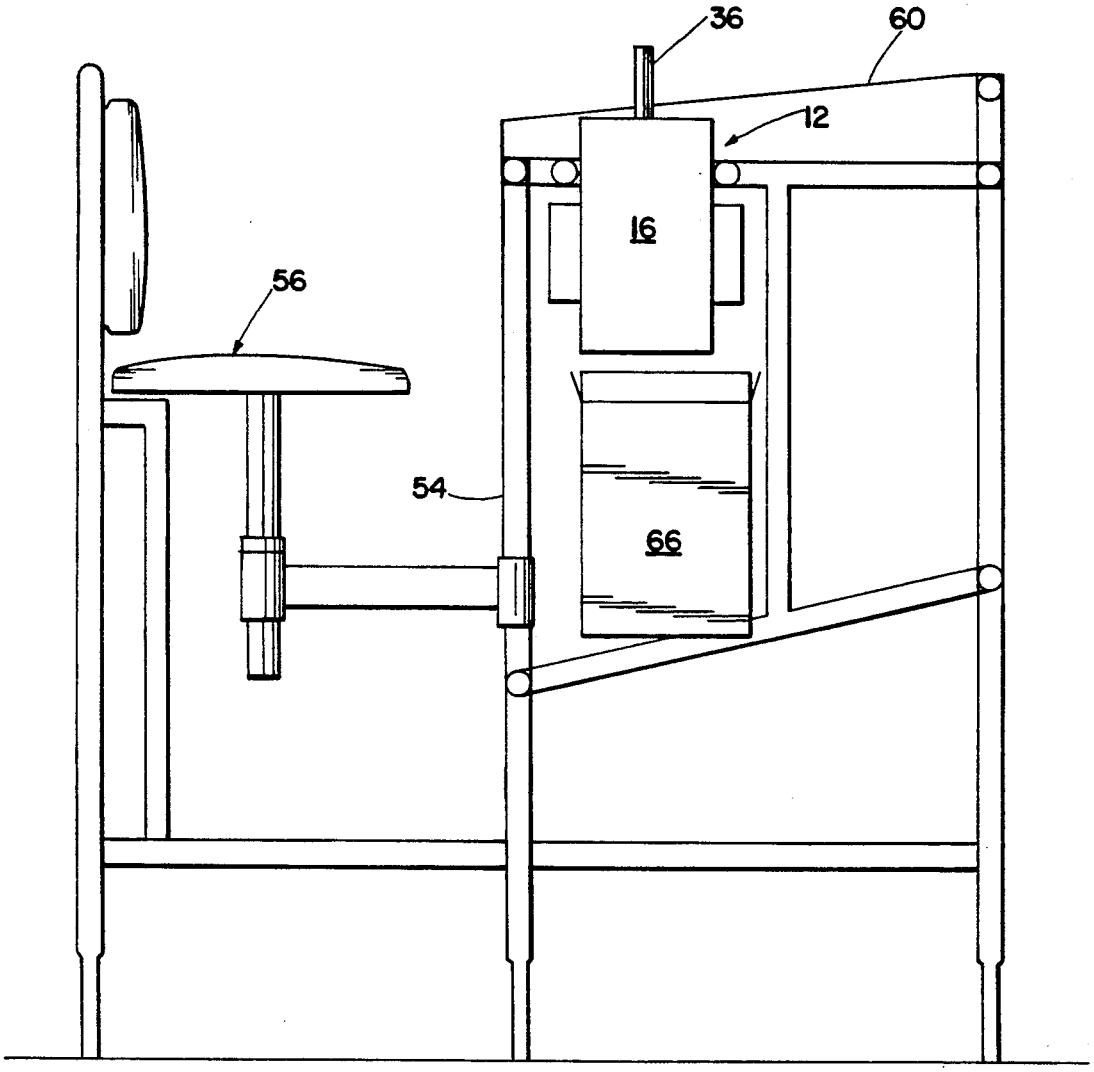
FIG. 3 is a side view of the apparatus of FIGS. 1 and 2.

FIGS. 1–3 illustrate apparatus 10, generally, comprising dispensing assembly 12 and feeding assembly 14. Preferably, dispensing assembly 12 includes dispenser body 16, gate 20, and actuating means 22; and feeding assembly 14 includes conveyor means 24 and drive means 26. More specifically, gate 20 includes first and second sections 30 and 32 and biasing means 34 (shown in FIGS. 4 and 5); actuating means 22 includes an extendable cylinder 36 and plunger 40; conveyor means includes pulleys **42*a* and 42*b*, belt 44, and cleats 46; and drive means 26 includes motor 50, clutch/brake means 52, and gear reducer 52A. With the embodiment of apparatus 10 illustrated in FIGS. 1–3, feeding assembly 14 further includes stand or frame 54, swivel chair 56, and work table 60. In addition, FIGS. 1 and 2 show a multitude of articles or premiums 62, and a second conveyor 64 that carries a multitude of packages 66 past apparatus 10. One of these packages is also shown in FIG. 3; however, for the sake of clarity, conveyor 64** has been omitted from this latter Figure.

Dispensing assembly 12 is provided to dispense articles 62 into packages 66 moving past the dispensing assembly. In particular, dispenser body 16 defines a loading chamber **16*a* for holding those articles, an inlet 16*b* for conducting the articles into the loading chamber, and an outlet 16*c* for dispensing the articles from the loading chamber. Gate 20 is connected to dispenser body 16 for movement between open and closed positions. In its closed position, the dispenser gate extends across outlet 16*c* of dispenser body 16 to hold articles 62 therein; and in its open position, gate 20** allows articles to pass out of the dispenser body, through the dispenser outlet.

Figure 4:
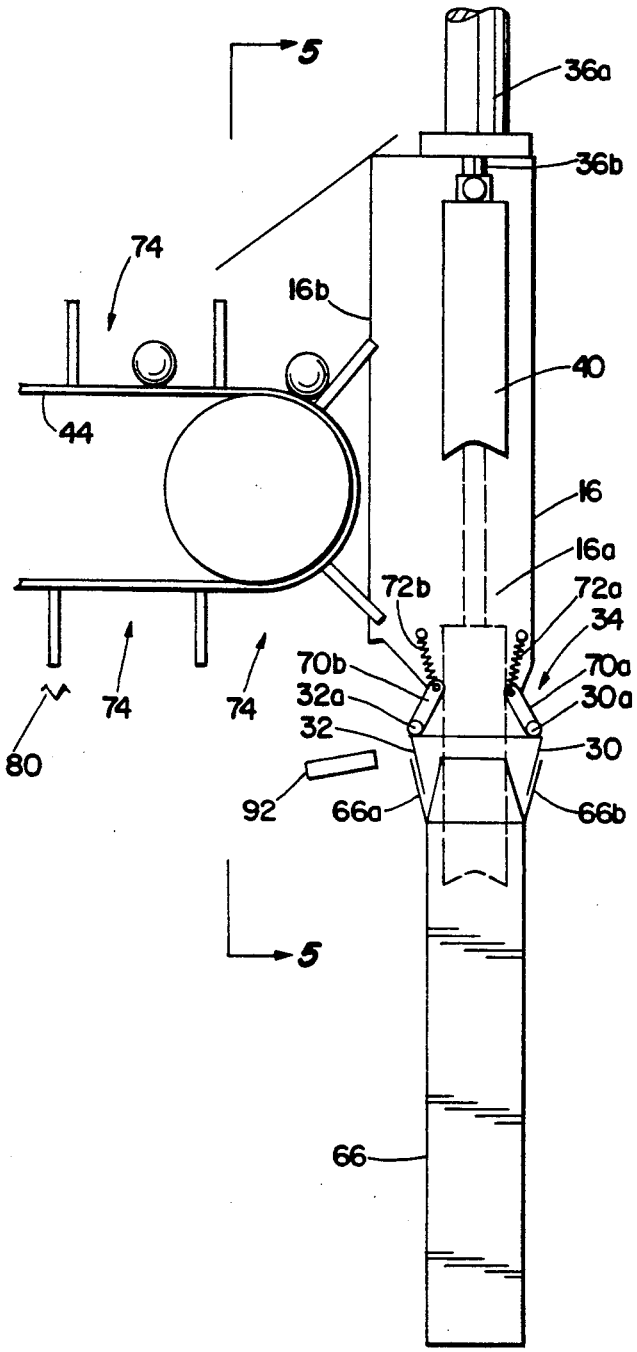
FIG. 4 is an enlarged view of a portion of the apparatus of FIG. 1.
Figure 5:
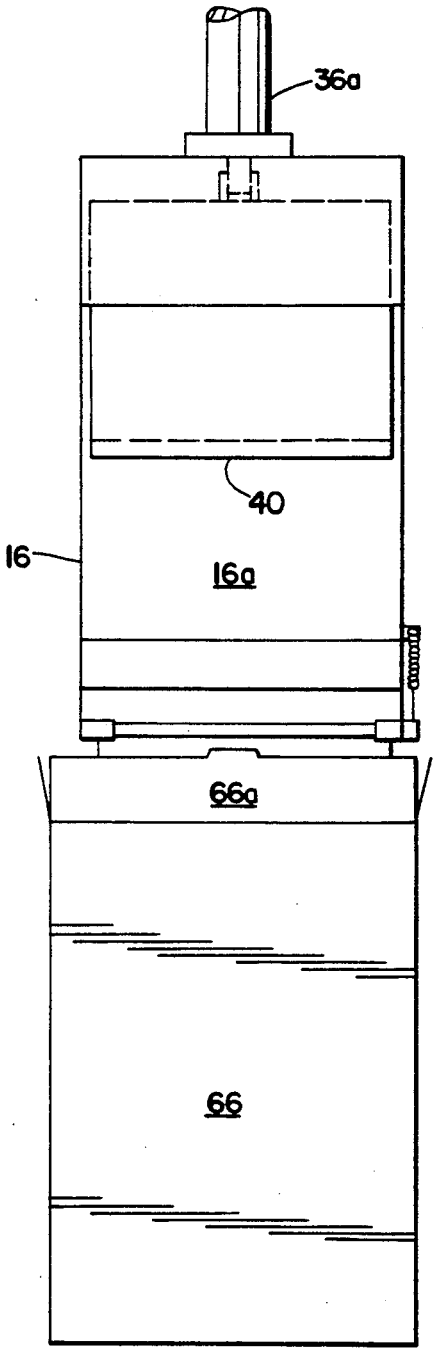
FIG. 5 is a side view of FIG. 4, taken along line V—V thereof.

Dispenser gate 20 is shown in greater detail in FIGS. 4 and 5; and with reference thereto, each of sections 30 and 32 is pivotally connected to dispenser body 16 for pivotal movement toward and away from dispenser outlet **16*c*. In particular, as viewed in FIG. 4, sections 30 and 32 are connected to dispenser 16 for pivotal movement about axis, 30*a* and 32*a* respectively, that are adjacent to the left and right edges, respectively, of dispenser outlet 16*c***.

Biasing means 34 is connected to sections 30 and 32 to urge those gate sections toward dispenser outlet **16*c*—that is, upwards as viewed in FIG. 4. More specifically, this biasing means includes first and second arms 70*a* and *b* and first and second springs 72*a* and *b*. Arm 70*a* is connected to gate section 30 for pivotal movement therewith, and spring 72a is connected to arm 70a and to dispenser body 16. When gate section 30 is pivoted downward about axis 30a, spring 72a applies a force to arm 70a urging that arm clockwise about axis 30a, and the arm, in turn, urges gate section 30 clockwise about that same axis. Similarly, arm 70b is connected to gate section 32 for pivotal movement therewith, and spring 72b is connected to arm 70b and to dispenser body 16. When gate section 32 is pivoted downward about axis 32a, spring 72b applies a force to arm 70b urging that arm counter-clockwise about axis 32a, and the arm urges gate section 32 counter-clockwise about axis 32a**.

The type of packages 66 shown in FIGS. 1-5 include a top end forming a package opening, and a pair of flaps 66a and *b* that are used to close that opening after the package has been filled with a product. With the preferred embodiment of gate 20 described above, as gate 20 opens to dispense one of the articles 62 into one of the packages 66, gate members 30 and 32 engage the top flaps of the package and hold those flaps in an open position while the article is being inserted into the package.

Gate sections 30 and 32, arms 70a and *b*, and springs 72 *a* and *b* may be secured in dispensing assembly 12 in any suitable manner. For example, each of the gate sections may be mounted on a respective one shaft that itself is mounted on dispenser body 16 adjacent or at one of the edges of dispenser outlet 16c. Arm 70a may be welded, or otherwise directly connected, to gate section 30 or to its mounting shaft for pivotal movement with this gate section; and arm 70b may be welded, or otherwise directly connected, to gate section 32 or to its mounting shaft for pivotal movement with this gate section. One end of spring 72a may be directly connected to arm 70a and the other end of this spring may be mounted on a projection connected to and extending outward from dispenser body 16. Likewise, a first end of spring 72b may be directly connected to arm 70b, and a second end of this spring may be mounted on a projection connected to the dispenser body 16.

Actuating means 22 is supported by or adjacent dispenser body 16 and is provided to move gate 20 from its closed position to its open position. With the embodiment of dispensing assembly 12 illustrated in the drawings, the actuating means is used to engage gate sections 30 and 32 and to push those gate sections away from dispenser outlet 16c, against the force of biasing means 34, co allow articles in dispenser 16 to pass out therefrom through outlet 16c.

More specifically, actuating means 32 preferably includes extendable pneumatic cylinder 36 and plunger 40; and cylinder 36, in turn, includes body section 36a and slidable rod 36b. Cylinder body 36a is securely connected to dispenser body 16, for example, at or adjacent a top end thereof. Cylinder rod 36b is supported by cylinder body 36a for sliding movement relative thereto, and the cylinder rod extends into the interior of the dispenser body 16. Plunger 40 is also located inside dispenser body 16 and is connected to a first, or lower, end of cylinder rod 36b for upward and downward sliding movement therewith between raised and lowered positions, shown in full and broken lines, respectively, in FIG. 4.

With the above-described arrangement, as cylinder 36 extends, cylinder rod 36b is moved downward, and plunger 40 moves downward with the cylinder rod. As the plunger moves downward, it engages any article inside loading chamber 16a, and further downward movement of plunger 40 forces gate sections 30 and 32 away from dispenser outlet 16c and forces any article in loading chamber 16a out through the dispenser outlet. The article is then pushed by plunger 40, or falls under the force of gravity, into one of the packages 66. After the article has been dispensed from dispenser 16, cylinder 36 is retracted. This pulls plunger 40 upward back into its raised position; and as this occurs, gate sections 30 and 32 are pulled back, under force of springs 72a and *b*, to close dispenser outlet 16c.

As will be understood by those of ordinary skill in the art, any suitable means may be used to extend and retract cylinder 36, and preferably a spring biased control valve (not shown) is employed to conduct pressurized air to the cylinder to selectively extend or retract that cylinder. For example, this control valve may be spring biased to a first position in which the valve directs pressurized air from a source thereof to cylinder 36 to retract rod 36b, or to hold that rod in its retracted position, and an electrically operated solenoid may be used to move that control valve to a second position in which the valve directs air to the cylinder to extend rod 36b.

Feeding assembly 14 extends adjacent the inlet 16b of dispenser body 16 and is provided to receive articles 62 from a source thereof and to feed those articles into the dispensing assembly. More specifically, conveyor belt 44 is mounted on pulleys 42a and *b*, which are themselves rotatably supported at two spaced apart locations; and motor 50 is connected to one of those pulleys, via engageable clutch 52, to rotate that pulley and, thereby, to move conveyor belt 44 around an endless loop extending around the pulleys. Cleats 46 are connected to and spaced apart along belt 44, and these cleats extend outward from the belt and form a multitude of article receiving compartments 74. Pulleys 42a and *b* and motor 50 may themselves be supported in any suitable manner; and, for example, these elements of feeding assembly 14 may be supported by stand 54.

Conveyor belt 44 is located immediately adjacent work table 60; and in the operation of apparatus 10, a supply of the articles 62 is placed on the work table and an operator then places those articles in compartments 74, typically one article per compartment. Motor 50 is operated to move conveyor belt 44 and compartments 74 around the above-mentioned enless loop; and as a given compartment passes around pulley 42b, the article in that compartment falls out of the compartment, through dispenser inlet 16b and into loading chamber 16a. The thus emptied compartment then travels to pulley 42a, passes around that pulley, and then travels back toward pulley 42b and dispenser 16. The operator places another article in the given compartment, and the compartment is again used to deliver an article into loading chamber 16a.

For the convenience of the operator, swivel chair 56 is provided so that the operator has a choice of either sitting or standing while placing the articles in conveyor compartments 74. Also, table 60 is preferably hinged and, when lifted, provides access to the drive means 26 of feeding assembly 14. In addition, preferably guard plate 76 is connected to dispenser body 16 and extends downwardly therefrom toward conveyor belt 44 to guard against undesired objects entering the dispenser body. With the embodiment of the invention illustrated in the drawings, plate 76 is pivotally connected to dispenser body 16; and if the plate is pivoted toward dispenser inlet 16*b*, a limit switch is engaged or disengaged to stop temporarily motor 50 and movement of conveyor belt 44, in a manner more fully discussed later.

Preferably, apparatus 10 is further provided with a control assembly to coordinate the operation of dispensing assembly 12 and feeding assembly 14 so that each time one of the packages 66 passes beneath dispenser 16, one, and preferably only one, of the articles 62 is inserted into that one package. Preferably, this control assembly operates feeding assembly 14 to feed a respective one of the articles 62 into dispenser 16 for each one of the packages 66 that passes therebeneath, and even more preferably, to feed these articles into dispenser 16 one at a time and at the same rate at which packages 66 pass therebeneath.

Figure 6:
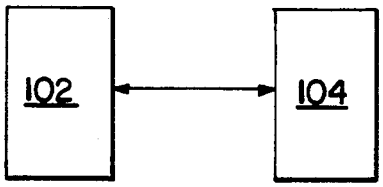
FIG. 6 schematically show two processors that may be used with the apparatus of FIGS. 1–3.

With reference to FIG. 6, preferably the control assembly for apparatus 10 includes a processor 102, which is programmed to operate that apparatus in a predetermined manner. FIG. 6 also shows a second processor 104, which is used to control second conveyor 64 and the movement of packages 66 therealong. Processors for controlling the movement of packages along a conveyor are well-known in the art, and it is unnecessary to describe processor 104, or any specific program for it, herein in detail. As schematically represented in FIG. 6, and as discussed below, signals are transmitted between the two processors 102 and 104, and modifications to the operation of conventional conveyor control processors that are necessary in order to accommodate apparatus 10 and control processor 102 will be well within the skill of those of ordinary skill in the art from a review of the following discussion.

Figure 7:
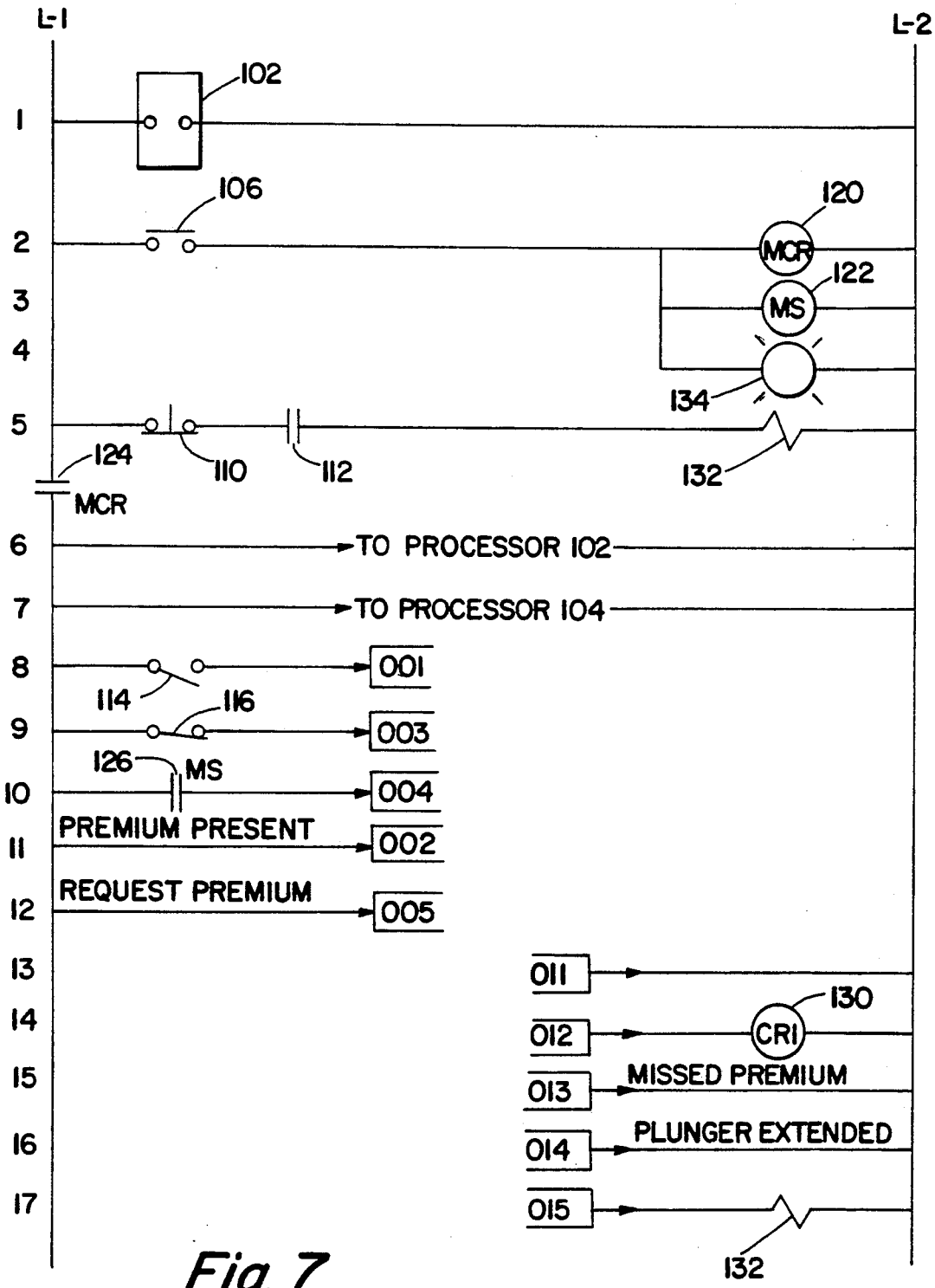
FIGS. 7 and 8 schematically illustrate a control procedure for the apparatus of FIGS. 1–3.
Figure 8:
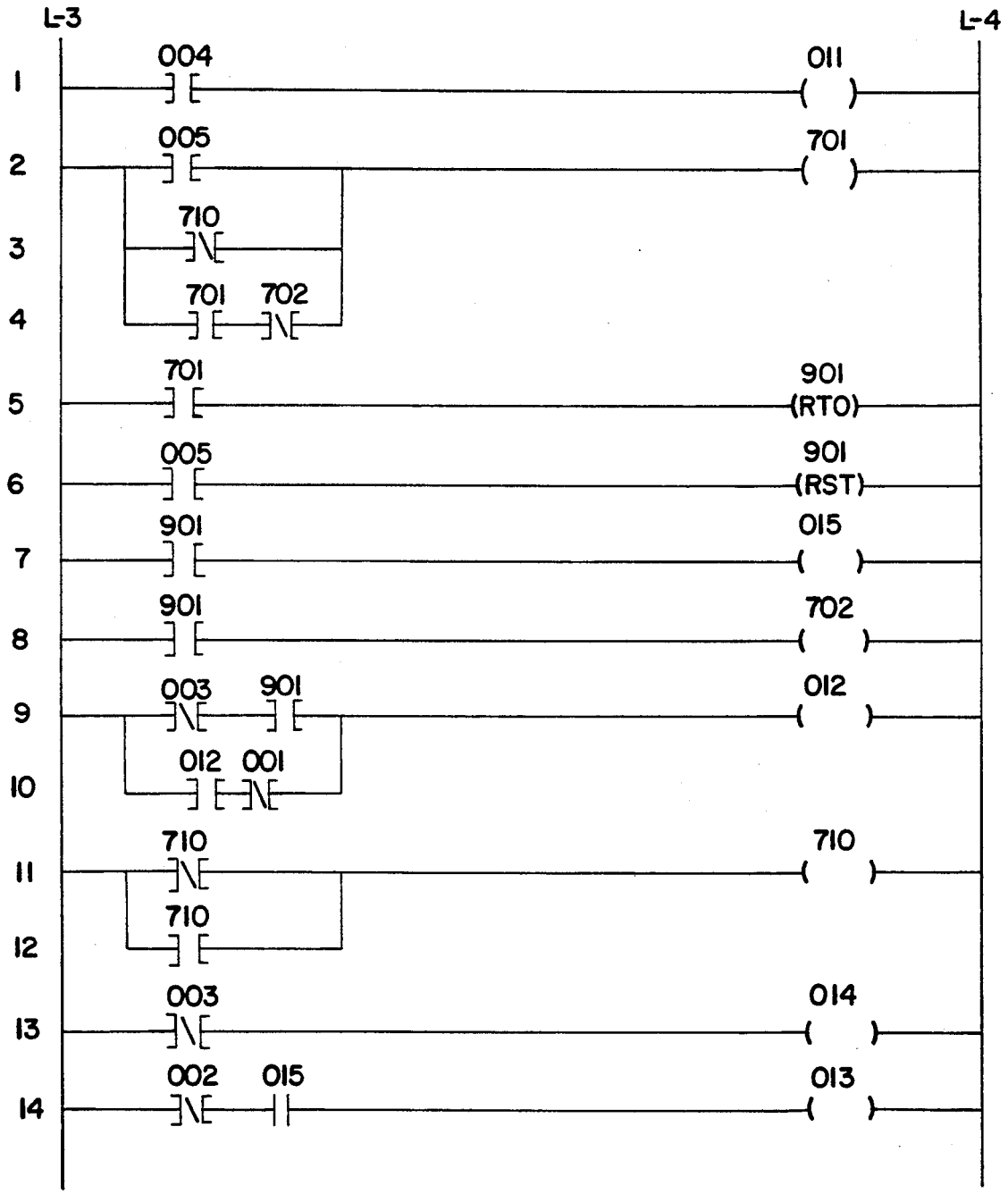

FIGS. 7 and 8 schematically illustrate one control procedure for operating apparatus 10. A multitude of items are depicted in these figures, and some of these illustrated items represent physical components while other depicted items represent functions performed by processor 102. For example, FIG. 7 shows switches 106 and 110, and preferably these represent physical switches that are used as on-off and emergency stop switches, respectively. Further, FIG. 8 schematically depicts contacts 004 and relay coil 011; however, these do not represent physical contacts or a physical relay coil, but instead represent functions performed by processor 102. In the discussion below of FIGS. 7 and 8, physical switches, relays, and contacts are referred to as switches, relays, and contacts, respectively; while depicted relays and contacts that represent functions of processor 102 are generally referred to as relay functions and contact functions, respectively.

To simplify references to FIGS. 7 and 8, these figures include numerical references 1–17 and 1–14, respectively, at the left of the figures to identify various lines therein. In addition, FIG. 7 shows Lines L-1 and L-2 and FIG. 8 shows Lines L-3 and L-4 to represent power sources or supplies for the various components illustrated in these figures. Control processor 102 is shown in Line 1 of FIG. 7, and the control assembly for apparatus 10 also includes start-stop switch 106, emergency stop switch 110, a guard plate proximity contact switch 112, a conveyor position switch 114 and a gate position switch 116. The control assembly for apparatus 10 further includes a master control relay 120, a conveyor motor starter relay 122, master control contact switch 124, and conveyor motor contact switch 126. The control assembly still further includes clutch/brake relay coil 130, and a plunger extend solenoid 132. The open blocks in FIG. 7 identified by the numbers 001, 002, 003, 004, and 005 represent input terminals of processor 102; and the open blocks identified by the numbers 011, 012, 013, 014, and 015 represent output terminals of the processor 102. Guard plate contact switch 112 is normally closed, however this switch opens when guard plate 76 is pivoted toward dispenser inlet 16*b*. Conveyor position switch 114 is normally open and switch 116 is normally closed, and the operation of these two switches is discussed further below.

Control processor 102 and on-off switch 104 are schematically shown, respectively, in Lines 1 and 2 of FIG. 7; and relays 120 and 122 and an indicator light 134 are shown, respectively, in Lines 2, 3, and 4 of FIG. 7. Emergency stop switch 110, guard plate switch 112, and solenoid 132 are all located in series in Line 5 of FIG. 7; and master control switch contacts 124 are located in Line L-1 of FIG. 7, between Lines 5 and 6 thereof. Line 6 represents a source of power for control processor 102, and Line 7 represents a source of power for processor 104.

Conveyor position switch 114, gate position switch 116, and motor starter contact switch 126 are located in Lines 8, 9, and 10 of FIG. 7; and these switches are used, respectively, to selectively transmit signals to input terminals 001, 003, and 004 of processor 102. Lines 11 and 12 are used, respectively, to transmit article present and article request signals, discussed below, to processor input terminals 002 and 005. Line 13 of FIG. 7 is used to transmit an interlock signal from processor 102 to processor 104, and Line 14 is used to transmit a signal to the clutch/brake relay coil 130 from processor output terminal 012. Lines 15 and 16 are used, respectively, to transmit a missed article signal and a plunger extend signal to the processor 104, and Line 17 of FIG. 7 is used to transmit a signal to solenoid 132 from processor output terminal 015 to actuate that solenoid.

Under initial conditions, on-off switch 106 is open, relays 120 and 122 are deactuated, emergency switch 110 and guard plate contact switch 112 are closed, and master control contact switch 124 is open. At the same time, conveyor position switch 114 is open, gate position switch 116 is closed, clutch/brake relay 130 is deactuated and plunger solenoid 132 is also deactuated.

To initiate operation of apparatus 10, on-off switch 106 in Line 2 of FIG. 7 is manually closed. This energizes relays 120 and 122 in Lines 2 and 3, and illuminates light 134 in Line 4 to indicate that apparatus 10 has been actuated. When relay 120 is energized, contact switch 124 is closed in Line L-1; and when relay 122 is energized, conveyor motor 50 is actuated and contact switch 126 is closed in Line 10 of FIG. 7. When this contact switch 124 closes in Line L-1, energy is provided to Lines 6-12 of the circuit shown in FIG. 7; and in particular, power is applied to processors 102 and 104. In addition, because switches 116 and 126 are closed, signals are applied to processor input terminals 003 and 004.

With reference to FIG. 8, particularly Line 1 thereof, when a signal is transmitted to processor input terminal 004, a signal is transmitted from processor output terminal 011. This output signal is transmitted to processor 104, as represented by Line 13 of FIG. 7, to inform this processor that apparatus 10 and motor 50 have been actuated.

Also, when apparatus 10 is first activated, a sequence of events, referred to as an initialization cycle, occur to load one article from feeding assembly 14 into loading chamber 16*a* of dispenser 16 so that an article is in that chamber before any of the packages 66 move beneath the dispenser. To elaborate, again with reference to FIG. 8, a processor relay function 701 in Line 2 is invoked via the contact function 710 in Line 3; and when this relay function is invoked, contact function 701 is invoked to form a closed switch in Line 4. This closed switch, in combination with the closed switch formed by contact function 702 in Line 4, form a holding circuit to maintain relay function 701 invoked in Line 2. In addition, when relay function 701 is invoked in Line 2, contact function 701 is invoked to form a closed switch in Line 5. This invokes relay function 901 in Line 5, this forms a closed contact switch 901 in Line 9, and this causes a signal to be transmitted from processor output terminal 012. This output signal invokes contact function 012 to form a closed switch in Line 10 of FIG. 8 so that this invoked contact function, in combination with the invoked contact function 001 in Line 10, form a holding circuit so that the processor output terminal 012 continues to transmit an output signal.

Also, when a signal is transmitted from processor output terminal 012, clutch/brake solenoid 130 is activated via Line 14 of FIG. 7. This operatively connects motor 50 to one of the pulleys 42*a* and b to move conveyor belt 44 and compartments 76 around those pulleys; and as a result, an article is deposited into the loading chamber 16*a* of dispenser 16 from the feeding assembly. Conveyor 44 continues to move around pulleys 42*a* and b until one of the cleats 46 moves to a position directly above optical sensor 80, shown in FIG. 4. When this occurs, switch 114 closes in Line 8 of FIG. 7, and a signal is applied to processor input 001. In response, processor contact switch function 001 opens in Line 10 of FIG. 8, braking the holding circuit that had maintained the clutch/brake solenoid 130 actuated. This deactuates that solenoid and stops movement of the conveyor 44, and thus brings the initialization cycle to an end.

When power is initially applied to processor 102, relay function 710 is invoked in Line 11 of FIG. 8 via the initially closed contact function 710 in that same line. This closes contact switch function 710 in Line 12, and this provides a holding circuit to keep relay function 710 invoked. However, when relay function 710 is invoked contact switch function 710 in Line 3 opens, insuring that the initialization cycle is not repeated as long as power remains continuously supplied to processor 102. Once the power to this processor is terminated, though, relay function 710 in Line 11 returns contact function 710 in Line 3 to its normally closed state, preparing apparatus 10 for the initialization cycle the next time power is applied to processor 102.

In addition, when apparatus 10 is initially actuated, switch 116 in Line 9 of FIG. 7 is normally closed, and a signal is thus applied to processor input terminal 003. Because of this, contact function 003 forms an open switches in Lines 9 and 13 of FIG. 8.

After apparatus 10 is actuated, conveyor 64 is operated to move packages 66 past dispensing assembly 12. When one of the packages reaches a predetermined position adjacent the dispensing assembly, a signal is generated and transmitted to processor input terminal 005. Any suitable means may be used to generate this signal; and, for example, a photo sensor or limit switch may be used to generate the desired signal when one of the packages reaches the predetermined position. Moreover, this predetermined position may be any suitable position; and, for instance, this position may be located directly below dispenser outlet 16*c*.

When this signal is transmitted to processor input terminal 005, a series of steps are taken to insert an article into the package 66 from loading chambers 16*c*, and a series of steps are also taken to load another article into the loading chamber from feeding assembly 14. More specifically, contact switches 005 close in Lines 2 and 6 of FIG. 7. When the former contact switch 005 closes, relay 701 is again energized; and when the contact switch 005 closes in Line 6, timer 901 is reset to 0. When this timer is reset, contact switches 901 close in Line 7 and 9 of FIG. 8. When switch 901 closes in Line 7, a signal is transmitted from processor output terminal 015, this energizes the plunger solenoid 132, and this moves the abovementioned control valve for extensible cylinder 36 to a position to extend that cylinder. The cylinder is then extended in the manner discussed above, to insert the article into the package from loading chamber 16*a*. When switch 901 closes in Line 9, a signal is transmitted from processor output terminal 012. This signal, as discussed above, closes contact switch 012 in Line 10 and causes conveyor motor 50 to begin to move the conveyor 44 to carry another article 62 into the loading chamber 16*a*.

When relay 701 is energized in Line 2, contact switch 701 is closed in Line 4, providing a holding circuit, with the closed switch 702, to maintain relay 701 energized. In addition, contact switch 701 closes in Line 5, and this starts the plunger timer. After that timer runs for a predetermined period of time, relay coil 901 is energized in Line 5, and this closes contacts 901 in Line 7. In response to this, relay coil 702 is energized in Line 8, and this opens contacts 702 in Line 4. This deenergizes relay 701 in Line 2, which opens contact switches 701 in Lines 4 and 5. When the latter switch opens, timer relay coil 901 in Line 5 is deenergized, and this causes switches 901 to open in Lines 7, 8, and 9. When switch 901 opens in Line 7, the plunger extend solenoid 132 returns to its normal position, which causes cylinder 36 to retract and causes the plunger 40 to return to its retracted position; and when switch 901 opens in Line 8, switch 702 closes in Line 5. The above-described series of events, first, returns plunger 40 to its retracted position, and second, prepares the various switches and relays of the control circuit for the next article insertion cycle.

Even after contact switch 901 opens in Line 9, conveyor belt 44 continues to move. This is because the holding circuit formed by switches 012 and 001 of Line 10 causes processor output terminal 012 to continue to transmit an output signal, which in turn maintains the clutch/brake solenoid 130 energized. Conveyor belt 44 and compartments 74 thus continue to move and another article 62 is carried into loading chamber 16*a*, and the conveyor belt continues to move further until one of the cleats 46 moves directly above sensor 80. When this happens, switch 114 closes, and a signal is transmitted to processor input terminal 001. As a result of this, switch 001 is opened in Line 10 of FIG. 8, and this brakes the above-mentioned holding circuit that had caused the processor output terminal 012 to continue to transmit an output signal. When this happens, the clutch/brake relay coil 130 is deenergized, motor 50 is disengaged from pulleys 42*a* and *b*, and conveyor belt 44 comes to a stop.

With the preferred embodiment of control assembly illustrated in FIGS. 7 and 8, a signal is transmitted to control processor 104 when gate 20 of dispensing assembly 12 is open. This signal may be used to stop movement of conveyor 64 so that packages 66 do not move along that conveyor while plunger 40 extends into one of those packages. To elaborate, whenever gate 20 is closed, switch 116 is closed in Line 9 of FIG. 7. This causes a signal to be applied to input terminal 003 of processor 102, and this causes contact switch 003 to open in Line 13 of FIG. 8. However, when gate 20 opens, a current is induced in sensor 92 (shown in FIG. 4), and this is used to cause switch 116 to open. This ends the signal that had been applied to processor input terminal 003, and this causes contact switch 003 to close in Line 13 of FIG. 8. This, in turn, causes a signal to be transmitted from processor output terminal 014, which is transmitted to processor 104 to indicate that plunger 40 is extended.

Moreover, preferably means are provided to determine whether each package has, in fact, been provided with an article from apparatus 10. For example, an ultrasonic generator may be used to generate ultrasonic sound waves and to transmit those waves to or through each one of the packages 66 when that package is directly below dispenser outlet 16*c*. As will be appreciated, the sound waves transmitted through or reflected from a particular package will be different depending on whether or not one of the articles 62 has been inserted into that package, and this difference may be employed to generate a signal each time a package below the dispenser outlet is sensed as having an article.

With reference to FIGS. 7 and 8, when one of the packages 66 directly beneath the dispenser outlet 16*c* is sensed as having an article, a signal is transmitted to processor input terminal 002, and this signal is used to hold contact switch 002 open in Line 14 of FIG. 8. When the above-mentioned signal is not applied to processor input terminal 002, contact switch 002 in Line 14 of FIG. 2 returns to a normally closed position. If this happens when contact switch 15 is closed in Line 14—which means that plunger 40 is extended through dispenser outlet 16*c*, but no article is sensed in the package below the dispenser outlet—then a signal is transmitted to processor 104 from output terminal 013 of processor 102.

This signal may be used to identify the package not having an article, so that this package may be removed from the stream of packages 66 having passed beneath dispenser 16. Also, processor 104 may keep track of the total number of packages not having any of the articles 62, and processor 104 may end the movement of packages 66 beneath dispenser 16 if, for instance, a given number of successive packages are found not to have any of the articles 62.

While it is apparent that the invention herein disclosed is well calculated to fulfill the objects previously stated, it will be appreciated that numerous modifications and embodiments may be devised by those skilled in the art, and it is intended that the appended claims cover all such modifications and embodiments as fall within the true spirit and scope of the present invention.

We claim:

1. Apparatus for inserting articles into packages, comprising:

a dispensing assembly including (i) a dispenser body defining a loading chamber for holding the articles, an inlet for conducting the articles into the loading chamber, and an outlet for dispensing the articles from the loading chamber, (ii) a gate connected to the dispenser body for movement between a closed position, wherein the gate extends across the outlet of the dispenser body to hold the articles in the loading chamber, and an open position to allow the articles to pass through the outlet of the dispenser body, and (iii) actuating means to move the gate from the closed position to the open position to dispense articles into the packages from the dispenser body; and a feeding assembly extending adjacent the inlet of the dispenser body for receiving the articles from a source thereof and transporting the articles into the inlet of the dispenser body;

wherein the packages move past the dispenser body one package at a time, and the apparatus further comprises a control assembly connected to the dispensing assembly and to the feeding assembly to operate the dispensing and feeding assemblies so that each time one of the packages moves past the dispenser body, a respective one of the articles is inserted into the one package and a respective another of the articles is transported into the dispenser body;

said feeding assembly including (i) a conveyor belt including a plurality of compartments for receiving the articles, and supported for movement along a predetermined path extending adjacent the inlet of the dispenser body, and (ii) drive means connected to the conveyor belt to move said conveyor belt around the predetermined path to deposit the articles into the dispenser body from the compartments of the conveyor belt;

said control assembly including (i) a first sensor to generate a first signal when one of the packages reaches a predetermined position adjacent the dispensing assembly, (ii) a second sensor located adjacent the conveyor belt to generate a second signal each time one of the compartments of the conveyor belt reaches a given position, and (iii) means connected to the first and second sensors to receive the first and second signals therefrom; and in response to receiving said first signal, (1) to operate the dispensing assembly to move the gate to the open position to dispense one of the articles into said one package, and (2) to operate the feeding assembly to feed another one of the articles into the dispenser body; and in response to receiving said second signal, to stop movement of the conveyor belt to prevent a further one of the articles from being deposited in the dispenser body while said another of the articles is therein.

2. Apparatus according to claim 1 wherein:

the gate includes (i) a first member pivotally connected to the dispenser body for movement toward and away from the outlet thereof, (ii) a second member pivotally connected to the dispenser body for movement toward and away from the outlet thereof, and (iii) means biasing the first and second members toward the outlet of the dispenser body; and the actuating means selectively engages the first and second members of the gate to force said members away from the outlet of the dispenser body to allow articles to move therethrough.

3. Apparatus according to claim 2 wherein the biasing means includes:

a first arm connected to the first member of the gate for pivotal movement therewith;

a second arm connected to the second member of the gate for pivotal movement therewith;

a first spring connected to the dispenser body and to the first arm, and urging the first arm to pull the first member of the gate toward the outlet of the dispenser body; and a second spring connected to the dispenser body and to the second arm, and urging the second arm to pull the second member of the gate toward the outlet of the dispenser body.

4. Apparatus according to claim 1 wherein the feeding assembly further includes:

first and second rotatable pulleys, said conveyor belt being mounted on said first and second pulleys; and drive means connected to the first pulley to rotate the first pulley and to move the conveyor belt around the predetermined path.

5. Apparatus according to claim 2 wherein each of the packages includes a respective one opening and a respective one pair of flaps to selectively open and close the opening in the package, and wherein:

the first member of the gate is adapted to engage a first of the pair of flaps of each of the packages and to hold said first flap in an open position; and the second member of the gate is adapted to engage a second of the pair of flaps of each of the packages and to hold said second flap in an open position.

6. A method of inserting articles into packages, comprising:

moving the packages one at a time past and below an article dispenser, the article dispenser defining a loading chamber for holding the article and an outlet for dispensing the articles from the dispenser, and including a bottom gate moveable toward and away from the dispenser outlet; and each time one of the packages moves beneath the dispenser, (i) opening said outlet to dispense one of said articles into the one package from the dispenser, and (ii) feeding another of the articles into the leading chamber of the article dispenser;

wherein the opening step includes the steps of (i) sensing and generating a first control signal each time one of the packages reaches a predetermined position below the dispenser, (ii) transmitting the first control signal to a control assembly, and (iii) the control assembly, opening the dispenser outlet in response to receiving the first control signal to dispense said one of the articles into said one of the packages; and wherein the feeding step includes the steps of placing the articles on a conveyor belt, and the control assembly, (i) moving the conveyor belt to deposit said another of the articles into the article dispenser, and (ii) stopping the conveyor belt in response to a second control signal generated each time the conveyor belt has moved a predetermined distance to prevent a further one of the articles from being deposited in the dispenser body while said another of the articles is therein.

7. A method according to claim 6 wherein the feeding step includes the step of feeding one of the articles into the dispenser in response to sensing said one of the packages reaching the predetermined position.

8. A method according to claim 6 wherein:

the conveyor belt includes a multitude of compartments;

the moving step includes the step of moving the conveyor belt around a continuous path extending adjacent the dispenser; and further including the step of, each time the conveyor assembly makes one complete pass around said path, positioning a respective one of the articles in each of said compartments.

9. Apparatus according to claim 4 wherein:

the means connected to the first sensor includes a processor; and in response to receiving the first signal, the processor operates the drive means to move the conveyor belt to deposit said another of the articles in the dispenser body.

10. Apparatus according to claim 9 wherein:

the conveyor belt includes a multitude of spaced apart cleats forming the plurality of compartments;

the processor is connected to the second sensor to receive the second signal therefrom; and in response to receiving the second signal, the processor stops movement of the conveyor belt to prevent said further one of the articles from being deposited in the dispenser body while another of the articles is therein.

11. A method according to claim 6 wherein the stopping step includes the steps of:

generating a belt stop signal after the conveyor belt has moved said predetermined distance;

transmitting the belt stop signal to the control assembly; and the control assembly, stopping the conveyor belt in response to receiving the belt stop signal.

* * * * *